US009650167B2

(12) United States Patent
Yamada et al.

(10) Patent No.: US 9,650,167 B2
(45) Date of Patent: May 16, 2017

(54) SEALING DEVICE

(75) Inventors: Kazukuni Yamada, Osaka (JP); Kazuyoshi Tarumoto, Osaka (JP); Yasuo Hashimoto, Osaka (JP); Junichi Kawaguchi, Osaka (JP); Suguru Akiyama, Osaka (JP)

(73) Assignee: Fuji Impulse Co., Ltd., Osaka (JP)

( * ) Notice: Subject to any disclaimer, the term of this patent is extended or adjusted under 35 U.S.C. 154(b) by 588 days.

(21) Appl. No.: 14/233,454

(22) PCT Filed: Jun. 20, 2012

(86) PCT No.: PCT/JP2012/065746

§ 371 (c)(1),
(2), (4) Date: Jan. 17, 2014

(87) PCT Pub. No.: WO2013/011794

PCT Pub. Date: Jan. 24, 2013

(65) Prior Publication Data

US 2014/0150382 A1 Jun. 5, 2014

(30) Foreign Application Priority Data

Jul. 20, 2011 (JP) ..... 2011-159062
May 31, 2012 (JP) ..... 2012-124676

(51) Int. Cl.
*B65B 51/10* (2006.01)
*B65B 31/06* (2006.01)
(Continued)

(52) U.S. Cl.
CPC ..... *B65B 51/10* (2013.01); *B65B 31/06* (2013.01); *B65B 51/146* (2013.01); *B65B 57/02* (2013.01)

(58) Field of Classification Search
CPC ... B65B 31/043; B65B 31/046; B65B 31/048; B65B 31/06; B65B 51/10; B65B 51/146; B65B 51/14; B65B 57/02; B65B 7/06
(Continued)

(56) References Cited

U.S. PATENT DOCUMENTS 4,118,912 A 10/1978 Verbeke
4,479,844 A * 10/1984 Yamada ..... B29C 66/861 100/233
(Continued)

FOREIGN PATENT DOCUMENTS

CN 201214494 Y 4/2009
CN 101933657 A 1/2011
(Continued)

OTHER PUBLICATIONS

English translation of the International Preliminary Report on Patentability and Written Opinion of the International Searching Authority for PCT/JP2010/065746, issued on Jan. 21, 2014, 7 pages.
(Continued)

*Primary Examiner* — Hemant M Desai
*Assistant Examiner* — Valentin Neacsu
(74) *Attorney, Agent, or Firm* — Alston & Bird LLP

(57) ABSTRACT

A sealing device is provided which is capable of a two-step holding operation with the use of a linear solenoid. The sealing device includes a stopping mechanism for stopping a movement of a movable part that forms the linear solenoid when the linear solenoid is driven at a predetermined midway point between a start point and an end point after the nozzle part has been moved from the waiting position to the stop position, and for releasing the movable part from a stop to allow the movable part to move again and reach the end
(Continued)

point after the nozzle part has been returned from the stop position to the waiting position.

9 Claims, 11 Drawing Sheets

(51) Int. Cl.
*B65B 51/14* (2006.01)
*B65B 57/02* (2006.01)

(58) Field of Classification Search
USPC ..... 53/510, 432
See application file for complete search history.

(56) References Cited

U.S. PATENT DOCUMENTS

| | | | | |
|---|---|---|---|---|
| 4,650,535 | A * | 3/1987 | Bennett | B29C 66/8324 100/320 |
| 4,860,523 | A | 8/1989 | Teteishi et al. | |
| 5,772,565 | A * | 6/1998 | Weyandt | B29C 65/18 493/10 |
| 2001/0032710 | A1* | 10/2001 | Sadler | B29C 65/228 156/583.6 |
| 2003/0140603 | A1* | 7/2003 | Krasenics, Jr. | B65B 31/046 53/434 |
| 2007/0125498 | A1* | 6/2007 | Kataoka | B29C 65/02 156/583.1 |
| 2012/0080418 | A1* | 4/2012 | Sakamoto | B29C 65/224 219/243 |

FOREIGN PATENT DOCUMENTS

| | | | | |
|---|---|---|---|---|
| GB | 1393084 | A | 5/1975 | |
| JP | 11-20810 | A | 1/1999 | |
| JP | 2000-335521 | A | 12/2000 | |
| JP | 2001-146214 | A | 5/2001 | |
| JP | 2001146214 | * | 5/2001 | B65B 51/10 |
| JP | 3768728 | B2 | 4/2006 | |
| JP | 2011-51284 | A | 3/2011 | |
| KR | 2001 0049235 | A | 6/2001 | |

OTHER PUBLICATIONS

Office Action for Chinese Application No. 201280032381.0 dated Jul. 11, 2014.
International Preliminary Report on Patentability for Application No. PCT/JP2012/065746 dated Jan. 30, 2014.
Extended European Search Report from European Application No. 12814578.6 dated Nov. 19, 2014.
International Search Report from International Application No. PCT/JP2012/065746 dated Sep. 25, 2012.
Office Action for Korean Patent Application No. 10-2014-7000289 dated Aug. 13, 2015.
Final Office Action for Korean Patent Application No. 10-2014-7000289 dated Feb. 17, 2016.
Office Action for Taiwanese Patent Application No. 101122584 dated Feb. 8, 2017.

* cited by examiner

SEALING DEVICE

TECHNICAL FIELD

The present invention relates to a sealing device, and a sealing method that uses the sealing device. The sealing device includes a pressure member having a pressure element for pressing a seal portion of an object to be sealed, a heating member having a heating element for heating the seal portion, a nozzle part arranged to be insertable into the object to be sealed through an opening in the seal portion to suck out gas from inside of the object to be sealed or supply gas into the object to be sealed, a nozzle drive unit allowing the nozzle part to move between a waiting position and a stop position, and a linear solenoid for driving the pressure member such as to hold the seal portion between the pressure member and the heating member.

BACKGROUND ART

A sealing device that seals a sealed object by sucking out gas from or supplying gas to the inside of the sealed object is known from Patent Document 1. According to Patent Document 1, a nozzle is inserted into the sealed object from its opening, and the air inside the object is sucked out, or gas is supplied to the inside, with the opening and the nozzle being held between a pair of holders (at a first holding position). After that, the nozzle is pulled out from the opening, and, with the opening further being held between the holders (at a second holding position), the object is heat-sealed. This holding operation with the holders is performed by driving one or two air cylinders.

A sealing device that uses a linear solenoid is known from Patent Document 2. Patent Document 2 describes holding a sealed object with a pressure element of a pressure lever that moves up and down with a movement of a linear solenoid and a heating element.

PRIOR ART DOCUMENTS

Patent Documents

Patent Document 1: JP-A-2000-335521
Patent Document 2: JP-A-2011-51284

SUMMARY OF THE INVENTION

Problems to be Solved by the Invention

However, with the driving method that uses an air cylinder as in Patent Document 1, two air supply systems are required for the air cylinder. Solenoid valves are also required in each of the two systems for switching starting and stopping the air supply. Moreover, a compressor is required for supplying air.

On the other hand, the movable iron core of the linear solenoid of Patent Document 2 is configured to move a constant stroke distance when driven and cannot stop midway. That is, the linear solenoid cannot perform the two-step holding operation described in Patent Document 1 wherein it stops the movable iron core at the first holding position and then moves it again to the second holding position.

The present invention was made in view of the circumstances described above, its object being to provide a sealing device capable of a two-step holding operation with the use of a linear solenoid.

Means for Solving the Problems

To solve the above problems, a sealing device according to the present invention includes:

- a pressure member having a pressure element for pressing a seal portion of an object to be sealed;
- a heating member having a heating element for heating the seal portion;
- a nozzle part arranged to be insertable into the object to be sealed from an opening in the seal portion to suck out gas from inside of the object to be sealed or supply gas into the object to be sealed;
- a nozzle drive unit allowing the nozzle part to move between a waiting position and a stop position;
- a first linear solenoid for driving the pressure member such as to hold the seal portion between the pressure member and the heating member; and
- a stopping mechanism for stopping a movement of a first movable part that forms the first linear solenoid when the first linear solenoid is driven at a predetermined midway point between a start point and an end point after the nozzle part has been moved from the waiting position to the stop position, and for releasing the first movable part from a stop to allow the first movable part to move again and reach the end point after the nozzle part has been returned from the stop position to the waiting position.

With this configuration, the first movable part (for example movable iron core) of the first linear solenoid can be stopped at any given midway point (midway position), so that it can easily perform the two-step holding operation. Since the linear solenoid can be used as it is, the configuration can be realized at low cost, and the drive control is easier than an air cylinder system as it requires less associated devices (such as compressors and solenoid valves).

One example of a two-step operation (stopping at a midway point) of the first linear solenoid will be described with reference to FIG. 2A to FIG. 2C. The sealing device includes a pressure member 7, a heating member 31, a nozzle part 41, a nozzle drive unit (not shown), a first linear solenoid 12, a stopping mechanism 70, and a controller 5 for controlling the drive of the nozzle drive unit, first linear solenoid 12, and stopping mechanism 70 (and a second linear solenoid 73). The controller 5 may also control other drive units and other constituent elements. The stopping mechanism 70 here includes a pin 71, a spring 72, and the second linear solenoid 73. The pin 71 forms a second movable part of the second linear solenoid 73 here. The first movable part 14 of the first linear solenoid 12 is driven such that a lower end portion of the first movable part 14 moves from an initial position 201 to a midway (intermediate) point 202 and stops there (see FIG. 2B) after the nozzle part 41 has been moved from a waiting (original) position in FIG. 2A to a stop (protruded) position in FIG. 2B. The first movable part 14 thus stops at a position where the object to be sealed can be fixedly held between holding parts of the pressure member 7 and the heating member 31. The lower end portion of the first movable part 14 abuts on one end of the pin 71 at this time so that the first movable part 14 stops. Next, as shown in FIG. 2C, after the nozzle part 41 has been returned from the stop position to the waiting position, the first movable part 14 is released from the stop and moved to an end point 203. As the pin 71 of the second linear solenoid 73 moves downward in the drawing, the first movable part 14 can move downward. Namely, the first movable part 14 is subjected to a force that moves it downward even when it is paused, but is stopped there by the pin 71. The controller 5 controls the movement of the nozzle part 41, power application to (excitation of) the first linear solenoid 12, and power application to (excitation of) the second linear solenoid 73 of the stopping mechanism 70. The present invention is not limited to the configuration example of FIG. 2A to FIG. 2C and may be configured otherwise, which will be described more specifically later.

In the present invention, the pressure member should preferably include an elastic pressing portion pressing a portion near the seal portion, and the heating member should preferably include an elastic receiving portion holding the portion near the seal portion together with the pressing portion. As the nozzle part and the sealed object are held between the elastic pressing portion and the elastic receiving portion, the pressure element and the heating element can avoid contacting with the nozzle part directly, so that damage or deformation of the pressure element and the heating element, or damage or deformation of the nozzle part, can be prevented.

In one embodiment of the present invention, the stopping mechanism may include

- a pin that makes contact with a distal end portion of the first movable part of the first linear solenoid, and
- a pin moving mechanism that allows the pin to move in accordance with a movement of the first movable part and that stops the pin to stop the movement of the first movable part at the midway point. The movement of the first movable part can easily be stopped at a midway point, as the simple pin moving mechanism can freely stop and start the movement of the pin.

In one embodiment of the present invention, the pin moving mechanism may include a spring arranged at an end different from one end of the pin that makes contact with the distal end portion of the first movable part. Thereby, the pin that has moved with the movement of the first movable part can be automatically returned to its original position.

In one embodiment of the present invention, the pin moving mechanism may include a second linear solenoid having the pin as a movable part. Thereby, a linear solenoid capable of two-step movement can be realized with a simple mechanism, as the pin (movable part) can be stopped and moved freely by turning on and off the solenoid.

In the embodiment mentioned above, the pin includes a first diameter part and a second diameter part that has a smaller diameter than the first diameter part, and the pin moving mechanism further includes an engagement portion that engages with the second diameter part of the pin. For example, the pin moving mechanism has a first opening having a larger diameter than the first diameter part, and a second opening (engagement portion) having a diameter that is smaller than the first diameter part but larger than the second diameter part. When the pin is allowed to move, the pin is moved inside the first opening. To stop the pin, the second diameter part is positioned inside the second opening, whereby the movement of the pin is stopped. In another example, the pin moving mechanism has a hooked portion (engagement portion) that fits on the second diameter part. When the pin is allowed to move, the hooked portion is positioned away from the second diameter part. To stop the pin, the hooked portion is fitted on the second diameter part, whereby the movement of the pin is stopped. A linear solenoid, rotary solenoid, stepping motor or the like may be used for driving the engagement portion, and a spring may be used for returning it to its original position.

In the embodiment mentioned above, the stopping mechanism includes a slide part that makes contact with a plunger of the first movable part to stop the movement of the first movable part. The slide part has an opening with a size that is larger than the outer diameter of the first movable part and smaller than the plunger so that, to stop the movement of the first movable part, the opening is moved toward the first movable part and abutted to the plunger, whereby the movement of the first movable part is stopped at a midway point, and, the slide part is moved away from the first movable part to start moving the first movable part again.

In the embodiment mentioned above, the stopping mechanism further includes

- a second linear solenoid arranged adjacent to the first linear solenoid;
- a pin secured at one end to a first movable part of the first linear solenoid and moving relative to the second linear solenoid inside a first bore that extends through a second movable part of the second linear solenoid;
- a midway positioning portion extended from the second movable part of the second linear solenoid toward the first movable part of the first linear solenoid and formed with a second bore continuing from the first bore;
- a lock part that engages with a recess of the pin formed at a different end from the one end of the pin to stop the pin from moving when a distal end portion of the first movable part of the first linear solenoid makes contact with the distal end portion of the midway positioning portion to stop the first movable part of the first linear solenoid at the midway point, and
- a lock release part that releases engagement of the recess by entering between the lock part and the pin when a second movable part of the second linear solenoid has moved with the first movable part of the first linear solenoid having moved to the end point.

With this configuration, as the pin is locked at the midway point where it stopped, there is no need to apply power to the first linear solenoid, so that the power cost can be reduced. Also the load on the first linear solenoid is reduced, which enables stable operation.

In the embodiment mentioned above, the sealing device further includes a solenoid controller that drives the first linear solenoid and the second linear solenoid

- to move the first movable part from the start point to the midway point and to stop the second movable part, so that the first movable part stops at the midway point, and
- to move the first movable part from the midway point to the end point and to move the second movable part in a moving direction of the first movable part, so that the first movable part is released from the stop and starts moving again to reach the end point.

In the embodiment mentioned above, the solenoid controller stops power application to the first and second linear solenoids when the first movable part is pausing at the midway point.

The invention in another aspect provides a sealing method that uses a sealing device including a pressure member having a pressure element for pressing a seal portion of an object to be sealed; a heating member having a heating element for heating the sealed portion; a nozzle part arranged to be insertable into the object to be sealed from an opening in the seal portion to suck out gas from inside of the object to be sealed or supply gas into the object to be sealed; a nozzle drive unit allowing the nozzle part to move between a waiting position and a stop position; and a linear solenoid for driving the pressure member such as to hold the seal portion between the pressure member and the heating member. The sealing method includes the steps of: moving the nozzle part from the waiting position to the stop position and inserting the nozzle part into the object to be sealed from the opening in the seal portion;

stopping a first movable part of the first linear solenoid at a predetermined midway point between a start point and an end point (first step of holding operation);

sucking out gas from or supplying gas to the inside of the object to be sealed with the nozzle part;

returning the nozzle part form the stop position to the waiting position;

moving the first movable part from the midway point to the end point (second step of holding operation);

heating the seal portion to fuse between the pressure member and the heating member; and returning the first movable part from the end point to the start point.

MODE FOR CARRYING OUT THE INVENTION

Figure 1:
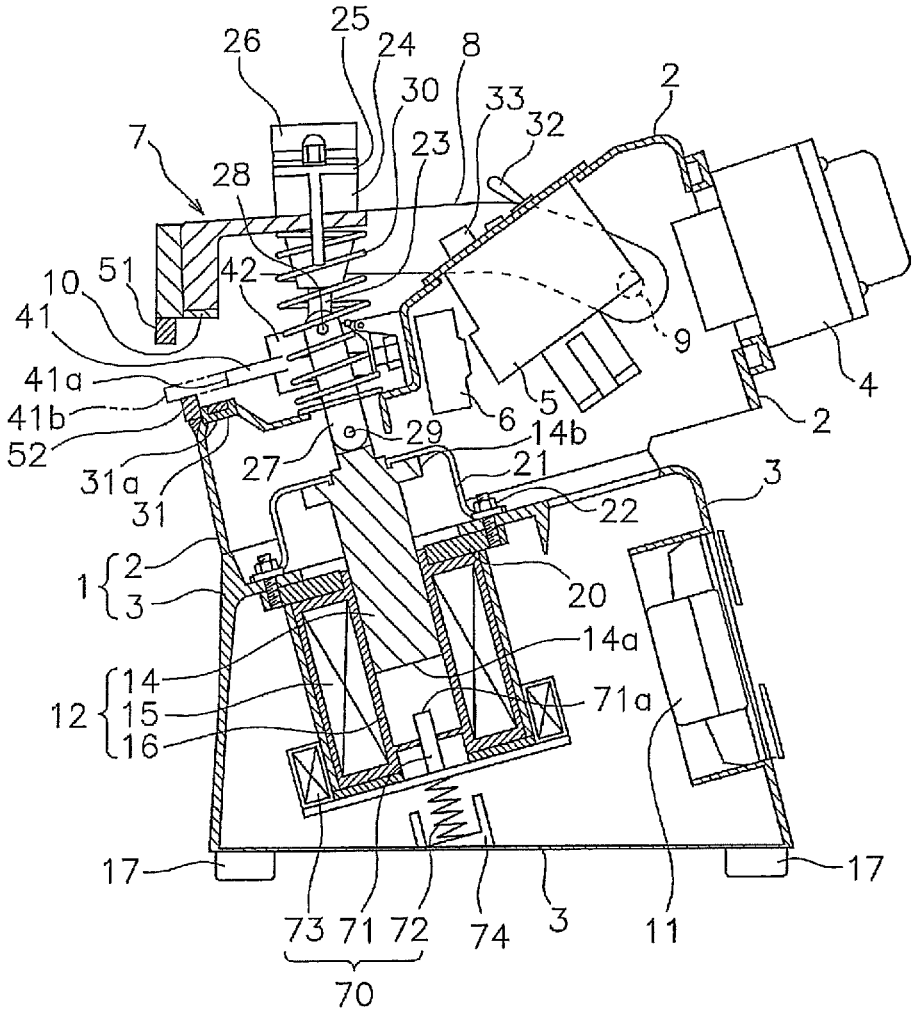
FIG. 1 is a cross-sectional side view showing the structure of a heat sealer of First Embodiment.
Figure 2A:
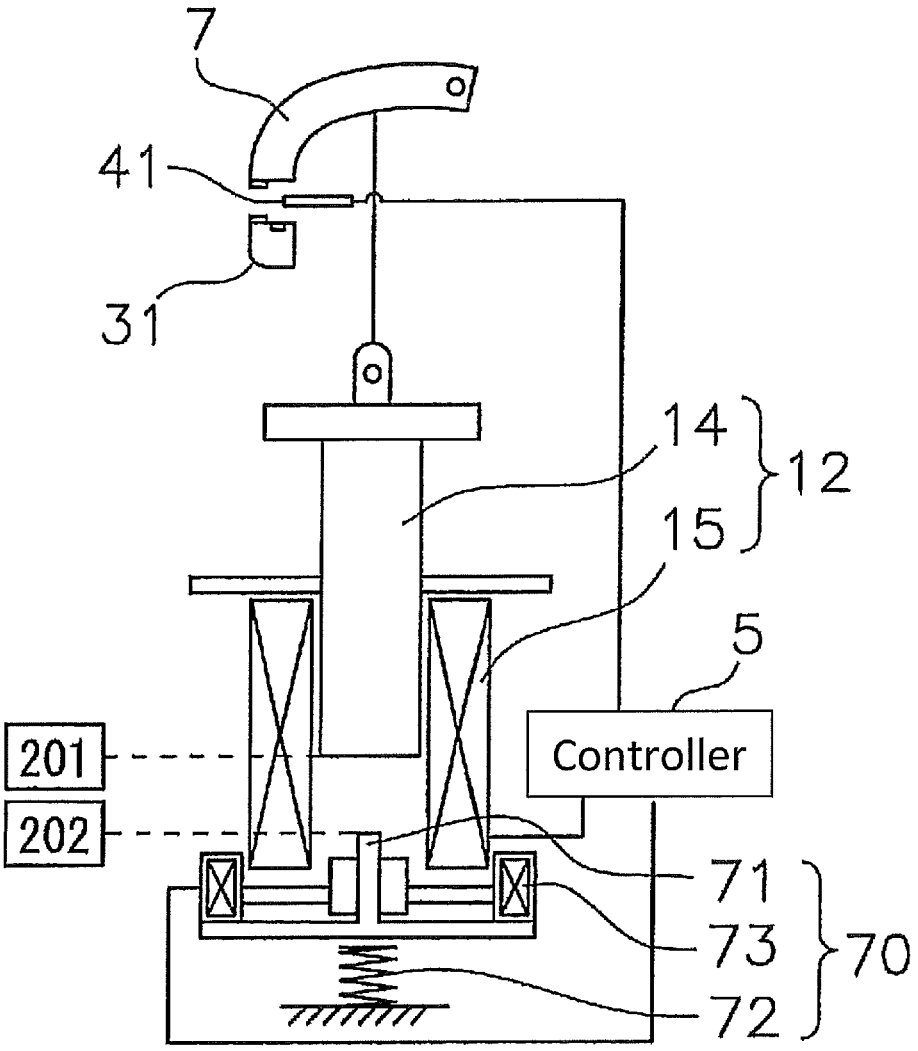
FIG. 2A is a diagram for explaining a two-step operation in First Embodiment.
Figure 2B:
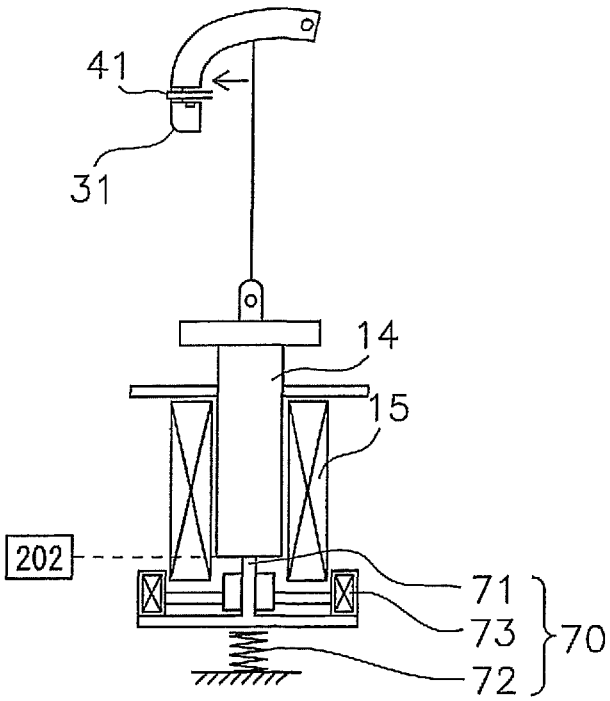
FIG. 2B is a diagram for explaining the two-step operation in First Embodiment.
Figure 2C:
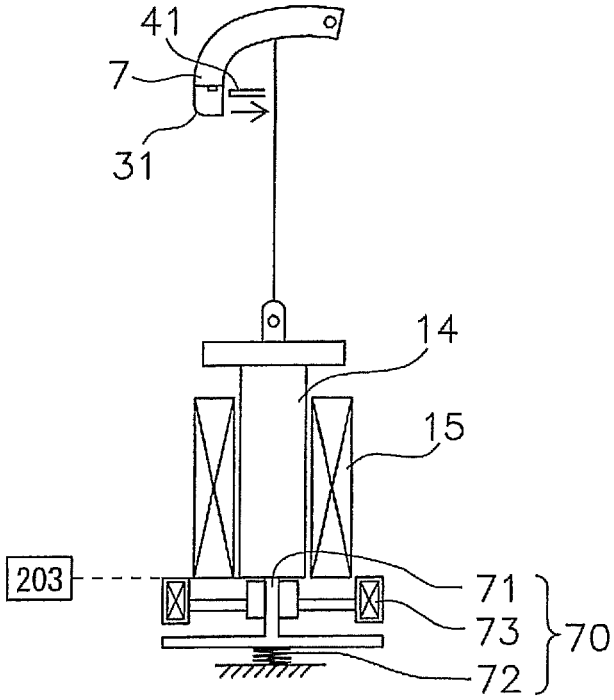
FIG. 2C is a diagram for explaining the two-step operation in First Embodiment.

An impulse heat sealer (hereinafter, simply "heat sealer") will be described as one example of a sealing device according to the present invention. The sealing device of the present invention is not limited to impulse heat sealers, but may be applicable to ultrasonic sealing devices, high frequency sealing devices and the like, for example. FIG. 1 is a cross-sectional side view showing the structure of the heat sealer. FIG. 2A to FIG. 2C are diagrams for explaining a stopping mechanism in detail.

<Overall Structure of the Heat Sealer>

The main body 1 of the heat sealer is formed by an upper frame 2 and a lower frame 3 that are integrally joined together. The upper frame 2 is equipped with a transformer 4, a control box 5 (housing a controller), a microswitch 6, and a pressure lever 7 (corresponding to "pressure member"). The pressure lever 7 has a pair of left and right arms 8 rotatably attached to a shaft 9. Silicone rubber mounted at the tip of the pressure lever 7 functions as a pressure element 10 that presses a seal portion of an object to be sealed.

The lower frame 3 is equipped with a cooling fan 11 and a first linear solenoid 12. The first linear solenoid 12 includes a movable iron core 14 (corresponding to "first movable part"), an electromagnetic coil 15, and a bobbin 16. The lower frame 3 has legs 17 on the lower surface. The first linear solenoid 12 is covered with a pair of upper and lower cover members (not shown) and mounted to the lower frame 3 via a support plate 20.

The movable iron core 14 is configured to be slidable along the inner circumference of the bobbin 16 so that the distal end surface 14*a* can contact with a end portion 71*a* of a pin 71 to be described later. A diaphragm 21 is mounted to the upper surface of the lower frame 3 by an attachment part 22 (bolt and nut attachment in the figure), and coupled to a flange 14*b* of the movable iron core 14. The attachment part 22 also has the function of connecting the support plate 20 to the lower frame 3.

The first linear solenoid 12 is located at a center position in the lateral width direction of the pressure lever 7. An operation rod 23 is slidably fitted also at a center position of the pressure lever 7. An elastic member 24 fitted on the operation rod 23 is held between a pressing part 25 that is also fitted on the operation rod 23, and the pressure lever 7. Rotating a pressure adjustment knob 26 threaded to the upper end of the operation rod 23 can finely change the position of the operation rod 23 up and down relative to the elastic member 24. The pressure lever 7 is stopped from moving upward from the initial position of FIG. 1 by a mechanism that is not shown.

The operation rod 23 and the movable iron core 14 are coupled to each other via a link lever 27 and link pins 28 and 29 provided at two locations. Thereby, the linear movement of the movable iron core 14 is converted to a rotary motion of the pressure lever 7. A compression coil spring 30 is arranged around the operation rod 23 and the link lever 27 between the upper frame 2 and the pressure lever 7 for returning the pressure lever 7.

A heating member 31 is attached to the lower frame 3. The heating member 31 includes a heating element 31*a* arranged opposite the silicone rubber pressure element 10, and the heating member 31 therefore includes a Nichrome wire or the like that functions as a heater.

The pressure lever 7 is provided with an elastic pressing portion 51 in front of the pressure element 10 for pressing a portion near the seal portion (closer to the bag center than the sealed portion) of the object to be sealed. An elastic receiving portion 52 is provided in front of the heating element 31*a* in the lower frame 3 to hold the portion near the seal portion of the object to be sealed in pair with this elastic pressing portion 51. The elastic pressing portion 51 and the elastic receiving portion 52 hold the portion near the seal portion of the object to be sealed. The arrangement of the elastic pressing portion 51 and the elastic receiving portion 52 is not limited to the one in which they are positioned in front of the pressure element 10 and the heating element 31*a*, and they may be located at the back of the pressure element 10 and the heating element 31*a* (on the inner side of the device body).

A nozzle part 41 is arranged to be insertable into the object to be sealed from an opening in the seal portion of the object to be sealed to suck out gas from inside of the object to be sealed or supply gas into the object to be sealed. In FIG. 1, the tip of the nozzle part 41 is located at the waiting position 41*a*. The tip of the nozzle part 41 advances to the stop position 41*b* to be inserted into the object to be sealed from an opening in the seal portion. A nozzle drive unit 42 is provided to move the nozzle part 41 between the waiting position 41*a* and the stop position 41*b*. The nozzle drive unit 42 can be formed, for example, by a drive power source such as a rotary solenoid, a stepping motor, a hydraulic cylinder, or an air cylinder, and a mechanism for moving the nozzle part 41 linearly such as, for example, a rack and pinion, a gear mechanism, a linear actuator, and the like.

A stopping mechanism 70 is provided to stop the movable iron core 14 of the first linear solenoid 12 at a midway (intermediate) point so as to hold the seal portion in two steps. When the first linear solenoid 12 is driven, the stopping mechanism 70 stops a movement of the movable iron core 14 that forms the first linear solenoid 12 at a predetermined midway point 202 that is set between a start point 201 where its lower end is positioned and an end point 203, after the nozzle part 41 has been moved from the waiting position 41*a* to the stop position 41*b*, and releases the movable iron core 14 from the stop to allow it to move again and reach the endpoint 203, after the nozzle part 41 has been returned from the stop position 41*b* to the waiting position 41*a*.

Figure 1B:
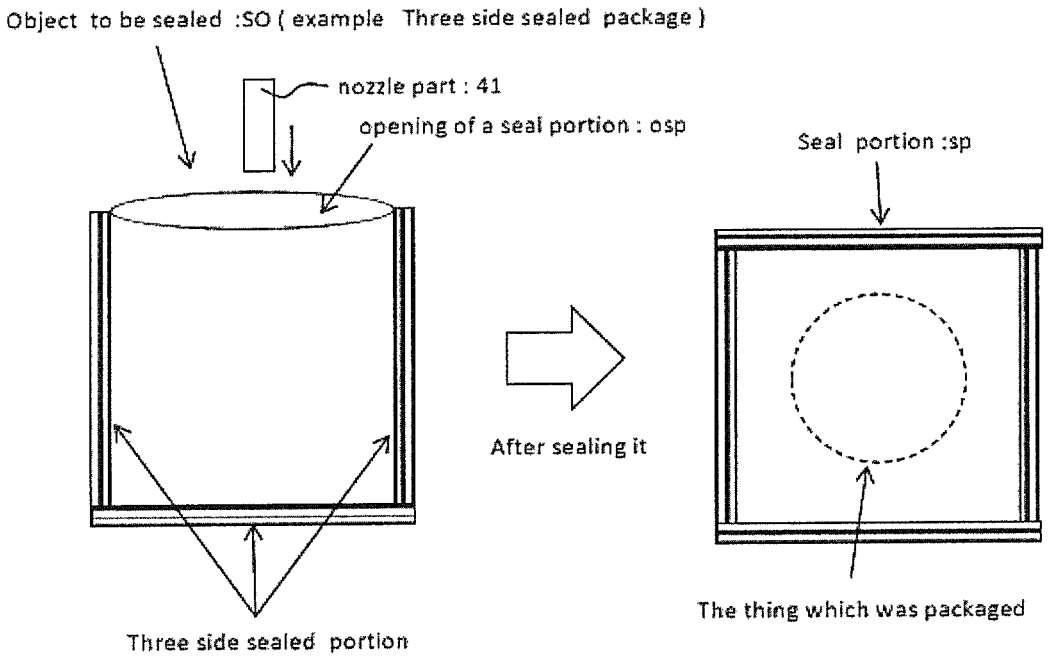
FIG. 1B illustrates a two-step operation for sealing an object.

The stopping mechanism 70 in FIG. 1, FIG. 2A, FIG. 2B, and FIG. 2C includes a pin 71 that can make contact with the distal end surface 14*a* of the movable iron core 14 of the first linear solenoid 12, and a pin moving mechanism (72, 73) that allows the pin 71 to move in accordance with the movement of the movable iron core 14 and to stop the movement so as to stop the movement of the movable iron core 14 at the midway point 202. This pin moving mechanism includes a spring 72 arranged at one axial end of the pin opposite from the axial end of the pin where the pin 71 contacts with the distal end surface 14*a* of the movable iron core 14, and a second linear solenoid 73 that has the pin 71 as its movable part (movable iron core). The spring 72 may be a compression coil spring, or a plate spring. A guide part 74 is provided around the spring 72 so as to restrict the moving direction of the pin 71 and to accommodate the pin. FIG. 1B shows a two-step operation for sealing an article to be sealed in an object to be sealed SO. In FIG. 1B, the object to be sealed SO is depicted as a three-sided sealed package having an opening of a seal portion osp, and a seal portion sp. In the first step, the object to be sealed SO includes an opening of a seal portion into which a nozzle part 41 may be used to introduce or remove a gas from an interior space of the object to be sealed SO. After sealing of the opening of the seal portion osp, a seal is formed to close the sealed portion sp of the object to be sealed.

FIG. 2A shows the movable iron core 14 located at the initial position 201. FIG. 2B shows a state in which the second linear solenoid 73 is turned on (the electromagnetic coil is powered) to keep the pin 71 in position so that it does not slide. When the first linear solenoid 12 is turned on (the electromagnetic coil 15 is powered), the movable iron core 14 stops moving downwards at the midway point 202 when the distal end surface 14*a* abuts on the end portion 71*a* of the pin 71. FIG. 2C shows a state in which the second linear solenoid 73 is turned off and where the pin 71 can freely slide downwards. When the second linear solenoid 73 is switched from the ON state to the OFF state, as the first linear solenoid 12 is still in the ON (powered) state, the movable iron core 14 starts moving again, until its distal end surface 14*a* reaches the end point 203, while it is kept in contact with the distal end portion 71*a* of the pin 71.

<Description of Sealing Process Including the Two-Step Holding Action>

First, the seal portion of the object to be sealed is placed in an open state between the pressure element 10 of the pressure lever 7 and the heating element 31*a* of the heating member 31 (step S1). Next, the nozzle part 41 is moved from the waiting position 41*a* to the stop position 41*b* so that the nozzle part 41 is inserted into an opening of the object to be sealed (step S2). Alternatively, the object to be sealed may be set after the nozzle part 41 has been moved to the stop position 41*b*.

Next, a first step of holding operation is performed (step S3). After (or before, or at the same time when) the nozzle part 41 has been moved to the stop position 41*b*, the linear solenoid 73 is turned on (electromagnetic coil is powered), so that the pin 71 will not slide and stay in position. Next, the first linear solenoid 12 is turned on (electromagnetic coil 15 is powered). This application of power may be performed automatically in response to a detection signal output from a sensor when it detects that a manual (or foot) switch has been turned on or the seal portion has been set.

When the first linear solenoid 12 is turned on, the movable iron core 14 moves downwards, and the pressure lever 7 moves downwards with it. The movable iron core 14 stops at the midway point 202 where the distal end surface 14*a* of the movable iron core 14 abuts on the end portion 71*a* of the pin 71, and the pressure lever 7 stops. At this time, a portion near the seal portion of the object to be sealed (position closer to the bag center than the seal portion) is held between the elastic pressing portion 51 and the elastic receiving portion 52 (first held state). The nozzle part 41 is held at the same time. Since the elastic pressing portion 51 and the elastic receiving portion 52 are made of an elastic material, the nozzle part 41 or the sealing device body do not suffer any damage. Next, the nozzle part 41 sucks out air from inside of the object to be sealed (or supplies gas into the object to be sealed) (step S4). The nozzle part 41 is connected to a suction machine (a vacuumer) not shown, a supply device (a compressor), or the like.

After a certain period of sucking (or supplying) action, a second step of holding operation is performed (step S5). The nozzle part 41 is moved from the stop position 41*b* to the waiting position 41*a*. The elastic pressing portion 51 and the elastic receiving portion 52 quickly fill in a gap formed after the nozzle part 41 has been moved. After that, the second linear solenoid 73 is switched from the ON state to the OFF state. Since the first linear solenoid 12 is still in the ON state (powered state), the movable iron core 14 starts to move again, pressing the end portion 71*a* of the pin 71 downwards with the distal end surface 14*a* thereof, and stops when the distal end surface 14*a* reaches the end point 203. At this time, the spring 72 is pressed by the bottom surface of the pin 71 and compressed.

With the downward movement of the movable iron core 14, the pressure lever 7 moves downwards, so that the elastic pressing portion 51 and the elastic receiving portion 52 are compressed to each other, whereby the seal portion of the object to be sealed is held between the pressure element 10 and the heating element 31*a*. When the pressure element 10 reaches the heating element 31*a* following the movement of the pressure lever 7 in this way, the microswitch 6 is turned on by a switch operation mechanism (not shown) to power the Nichrome wire. This fuses the seal portion of the object to be sealed held between the pressure element 10 and the heating element 31*a* and seals the object to be sealed (step S6). A power switch 32 and a cycle time adjustment knob 33 are provided at positions corresponding to the control box 5.

The control box 5 is also provided with a mechanism for adjusting the duration of power application to the Nichrome wire and the duration of excitation of the electromagnetic coil 15.

Next, when the sealing process is complete, the power application to the electromagnetic coil 15 is stopped, so that the movable iron core 14 is freed and moves upward by the action of the compression coil spring 30, the distal end surface 14*a* returning from the end point 203 to the start point 201. With that, the pressure lever 7 returns upwards to the initial position (step S7). The pin 71 returns to its initial position by the restoring force of the spring 72. The sealed object that is appropriately sealed at the sealed portion is then taken out.

Another Example 1 of First Embodiment

Figure 3:
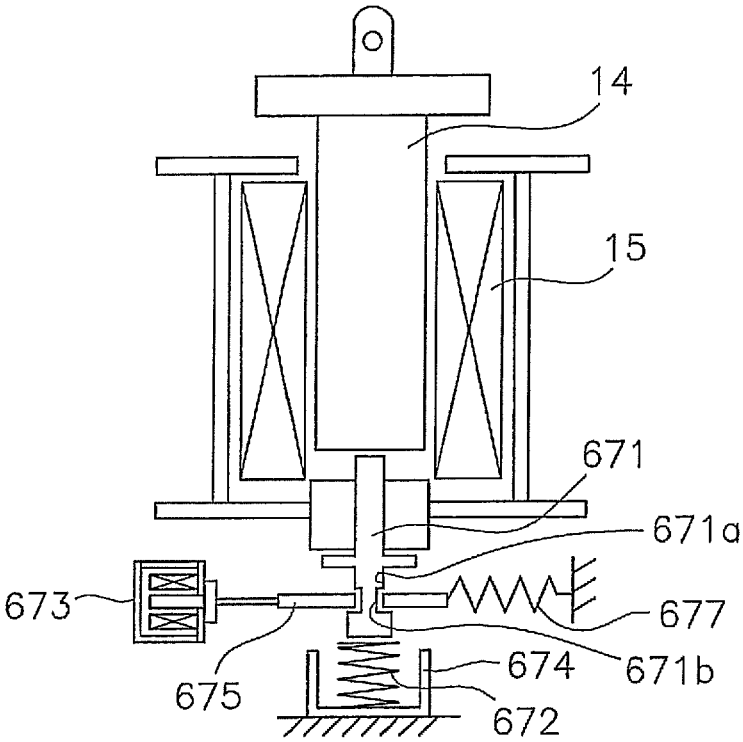
FIG. 3 is a diagram showing one example of a stopping mechanism in Variation Example 1 of First Embodiment.
Figure 4A:
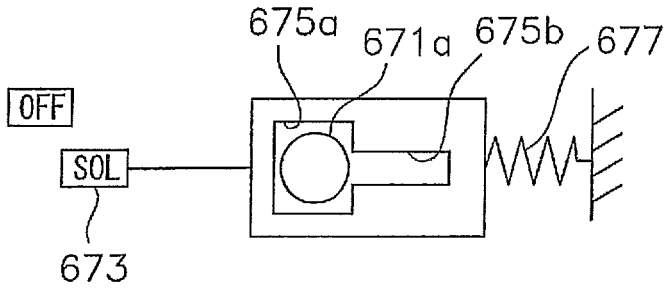
FIG. 4A is a diagram showing one example of the stopping mechanism in Variation Example 1 of First Embodiment.
Figure 4B:
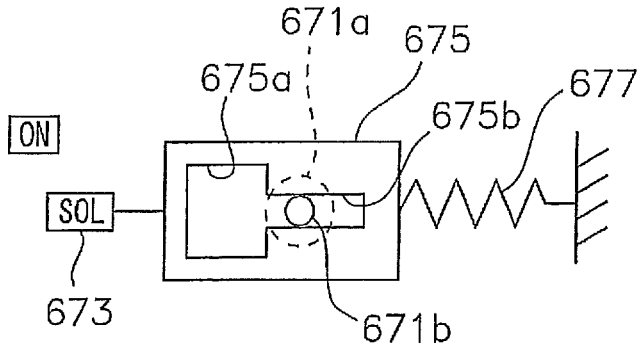
FIG. 4B is a diagram showing one example of the stopping mechanism in Variation Example 1 of First Embodiment.

FIG. 3, FIG. 4A, and FIG. 4B show another example of the stopping mechanism. The stopping mechanism includes a pin 671, a spring 672 arranged at an axial end face of the pin opposite from the axial end face of the pin 671 making contact with the movable iron core 14, and a guide part 674 housing the spring 672. The pin 671 has a first diameter part 671*a* and a second diameter part 671*b* having a smaller diameter than the first diameter part 671*a*. To stop the movement of the pin 671, the stopping mechanism includes a slide plate 675 and a solenoid 673 for sliding the slide plate 675 (corresponding to the pin moving mechanism). The slide plate 675 includes a first opening 675*a* having a larger size than the first diameter part 671*a*, and a second opening 675*b* having a size that is smaller than the first diameter part 671*a* but larger than the second diameter part 671*b* (corresponding to "engagement portion"). When the pin 671 is allowed to move, the pin 671 is moved inside the first opening. To stop the pin 671, the second diameter part 671*b* is positioned inside the second opening, whereby the movement of the pin 671 is stopped. FIG. 4A shows a state in which the solenoid 673 is turned off, so that the pin 671 being movable perpendicularly to the plane of the drawing. FIG. 4B shows a state in which the solenoid 673 is turned on (electromagnetic coil is turned on) to slide the slide plate 675 leftward in the paper plane against the pulling force of the spring 677 to position the second diameter part 671*b* inside the second opening. As the first diameter part 671*a* abuts on the slide plate 675 at this time, the pin 671 does not move downwards. When the solenoid 673 is switched from the ON state to the OFF state, the slide plate 675 returns to the initial position by the restoring force of the spring 677, so that the pin 671 is allowed to move and the movable iron core 14 moves to the end point. The restoring force of the spring 672 automatically returns the pin 671 to the initial position when the movable iron core 14 returns.

Another Example 2 of First Embodiment

Figure 5A:
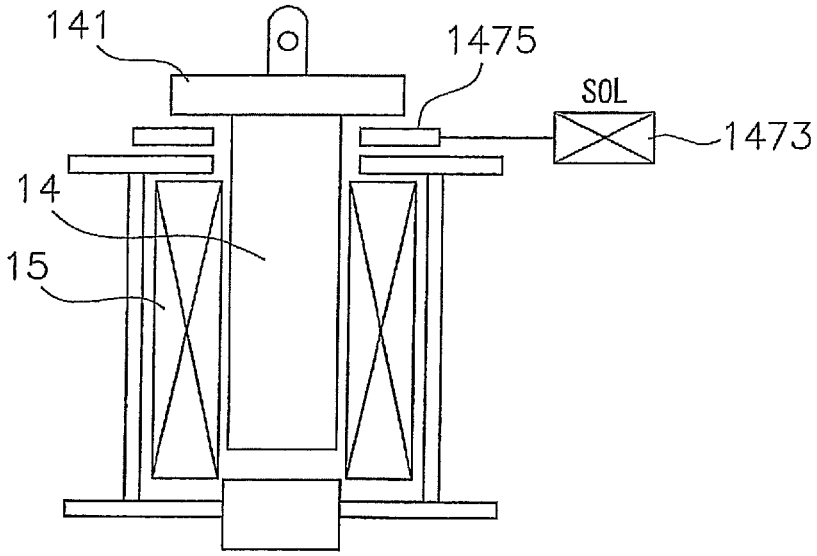
FIG. 5A is a diagram showing one example of a stopping mechanism in Variation Example 2 of First Embodiment.
Figure 5B:
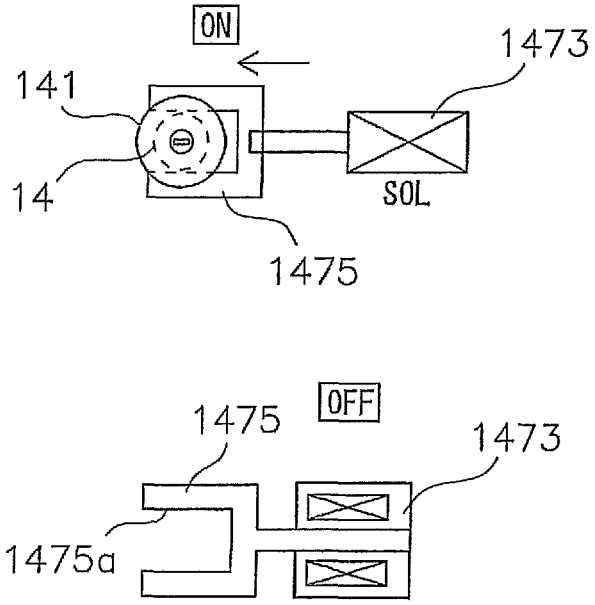
FIG. 5B is a diagram showing one example of the stopping mechanism in Variation Example 2 of First Embodiment.

FIG. 5A and FIG. 5B show another example of the stopping mechanism. The stopping mechanism does not include the pin described above. The stopping mechanism includes a U-shaped slide part 1475 with one open end for contacting a plunger 141 of the movable iron core 14 to stop the movement of the movable iron core 14, and a solenoid 1473 for moving this slide part 1475. The U-shaped open end 1475*a* of the slide part 1475 has a size that is smaller than the plunger 141 and larger than the outer diameter of the movable iron core 14. The U-shaped open end 1475*a* corresponds to "engagement portion". The operation will be described with reference to FIG. 5B. When the solenoid 1473 is in the OFF state, the slide part 1475 is waiting at a position away from the movable iron core 14. When the solenoid 1473 is turned on (electromagnetic coil is powered), the slide part 1475 is moved leftward in the paper plane so that the U-shaped open end 1475*a* fits on the movable iron core 14. As the plunger 141 abuts on the slide part 1475 at this time, the movable iron core 14 does not move downwards. When the solenoid 1473 is switched from the ON state to the OFF state, the slide part 1475 returns to the initial position, allowing the movable iron core 14 to move and reach the end point.

Sealing Device of Second Embodiment

Figure 6:
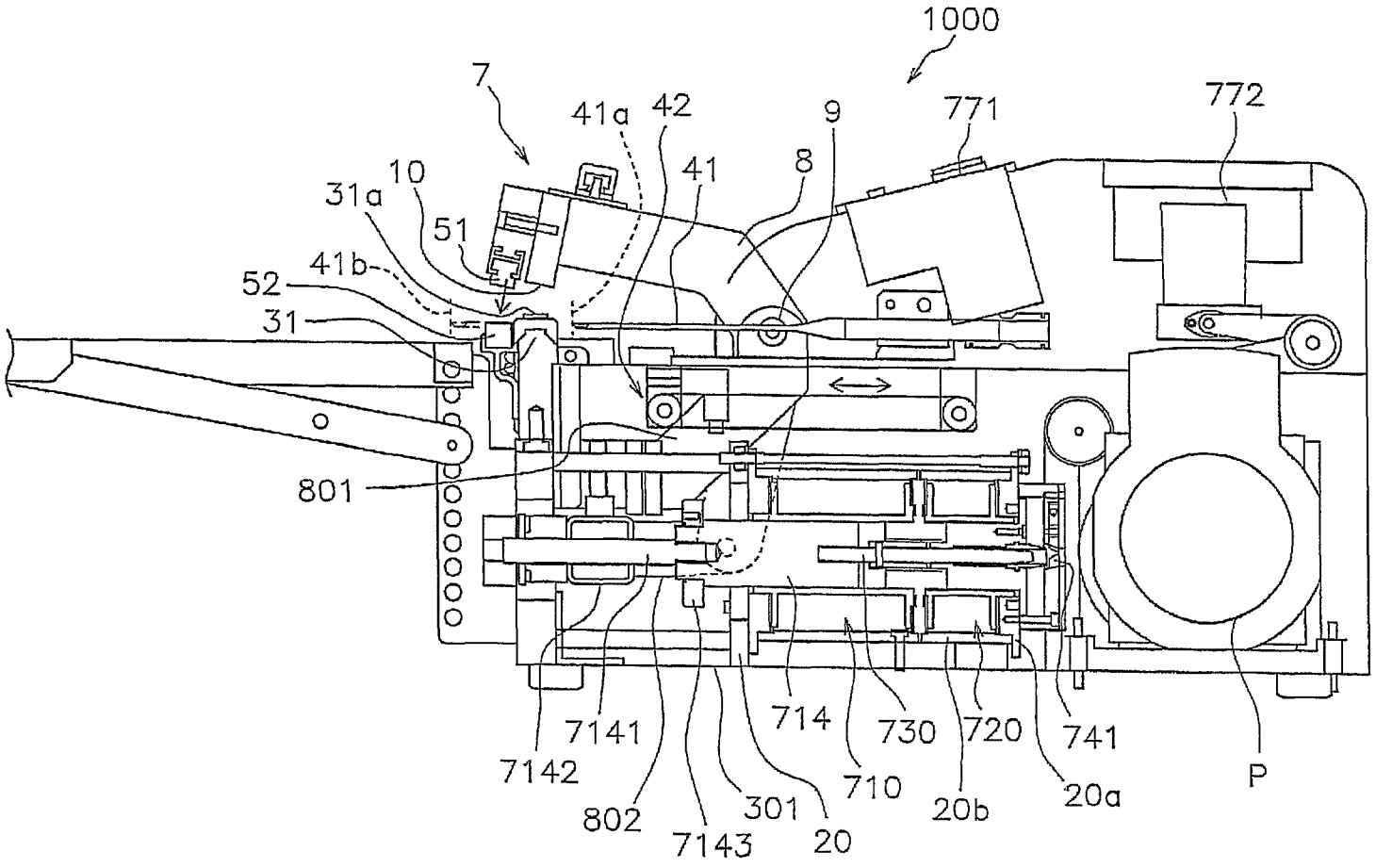
FIG. 6 is a cross-sectional side view showing the structure of a heat sealer of Second Embodiment.

While the sealing device of the embodiment described above is configured with the first linear solenoid oriented substantially in the up and down direction, the sealing device of this embodiment has a configuration in which the first linear solenoid is arranged laterally. FIG. 6 shows a cross-sectional side view of the sealing device.

<Overall Structure of Heat Sealer>

The main body 1000 of the heat sealer includes a pressure lever 7 (corresponding to "pressure member"), a first controller 771, a second controller 772, a vacuum pump P, and a transformer (not shown). The pressure lever 7 has a pair of left and right arms 8 rotatably attached to a rotation shaft 9. Silicone rubber mounted at the tip of the pressure lever 7 functions as a pressure element 10 that presses a seal portion of an object to be sealed.

A plunger 7143 is coupled to the distal end of a first movable iron core 714 (corresponding to "first movable part") of the first linear solenoid 710. One end of an operation rod 7141 is coupled to this plunger 7143, while the other end of the operation rod 7141 is attached to the housing of the device such that the operation rod can move left and right. A bar-like connecting portion 7142 having a rectangular cross section is secured to this operation rod 7141.

A pair of arms 8 on the left and right of the device when viewed from the front extend further downwards from the rotation shaft 9 in the drawing, and the lower ends 802 (left and right lower ends) of the arms 8 are each fixedly attached to both ends of the connecting portion 7142. The arms 8 are pulled by springs (not shown) fixedly attached to the housing and coupled to support portions 801 that extend from the rotation shaft 9 of the arms 8 toward the housing wall on the left side in the drawing.

The first linear solenoid 710 includes the first movable iron core 714, an electromagnetic coil 715, and a bobbin 716. The first linear solenoid 710, and a second linear solenoid 720 to be described later, are both supported on support members (20, 20*a*, 20*b*, and 20*c*), thereby being mounted to the lower part 301 of the housing.

The first movable iron core 714 is configured to be slidable along the inner circumference of the bobbin 716. One distal end portion 714*a* of the first movable iron core 714 can contact with a end surface 7241*a* of a pin 7241 to be described later. The side to side linear movement of the first movable iron core 714 is smoothly converted to a rotary motion of the pressure lever 7 via the plunger 7143, the operation rod 7141, and the connecting portion 7142 coupled one after another to the first movable iron core 714.

A heating member 31 is provided opposite the pressure element 10 of the pressure member 7. The heating member 31 includes a heating element 31*a* arranged opposite the silicone rubber pressure element 10, and the heating member 31 therefore includes a Nichrome wire or the like that functions as a heater.

The pressure lever 7 is provided with an elastic pressing portion 51 in front of the pressure element 10 for pressing a portion near the seal portion (closer to the bag center than the seal portion) of the object to be sealed. An elastic receiving portion 52 is provided in front of the heating element 31*a* to hold the portion near the seal portion of the object to be sealed in pair with this elastic pressing portion 51. The elastic pressing portion 51 and the elastic receiving portion 52 hold the portion near the seal portion of the object to be sealed. The arrangement of the elastic pressing portion 51 and the elastic receiving portion 52 is not limited to the one in which they are positioned in front of the pressure element 10 and the heating element 31*a*, and they may be located at the back of the pressure element 10 and the heating element 31*a* (on the inner side of the device body).

A nozzle part 41 is arranged to be insertable into the object to be sealed through an opening in the seal portion of the sealed object to suck out gas from inside of the object to be sealed or supply gas into the sealed object. In FIG. 6, the tip of the nozzle part 41 is located at the waiting position 41*a*. The tip of the nozzle part 41 advances to the stop position 41*b* to be inserted into the object to be sealed through the opening in the seal portion. A nozzle drive unit 42 is provided to move the nozzle part 41 between the waiting position 41*a* and the stop position 41*b*. The nozzle drive unit 42 can be formed, for example, by a drive power source such as a rotary solenoid, a stepping motor, a hydraulic cylinder, or an air cylinder, and a mechanism for moving the nozzle part 41 linearly such as, for example, a rack and pinion, a gear mechanism, a linear actuator, and the like.

A stopping mechanism 70 is provided to stop the first movable iron core 714 of the first linear solenoid 710 at a midway point so as to hold the seal portion in two steps. When the first linear solenoid 710 is driven, the stopping mechanism 70 stops the movement of the first movable iron core 714 at a predetermined midway point 202 that is set between a start point 201 and an end point 203 after the nozzle part 41 has been moved from the waiting position 41*a* to the stop position 41*b*, and releases the first movable iron core 714 from the stop and allows it to move again and reach the end point 203 after the nozzle part 41 has been returned from the stop position 41*b* to the waiting position 41*a*.

Figure 7A:
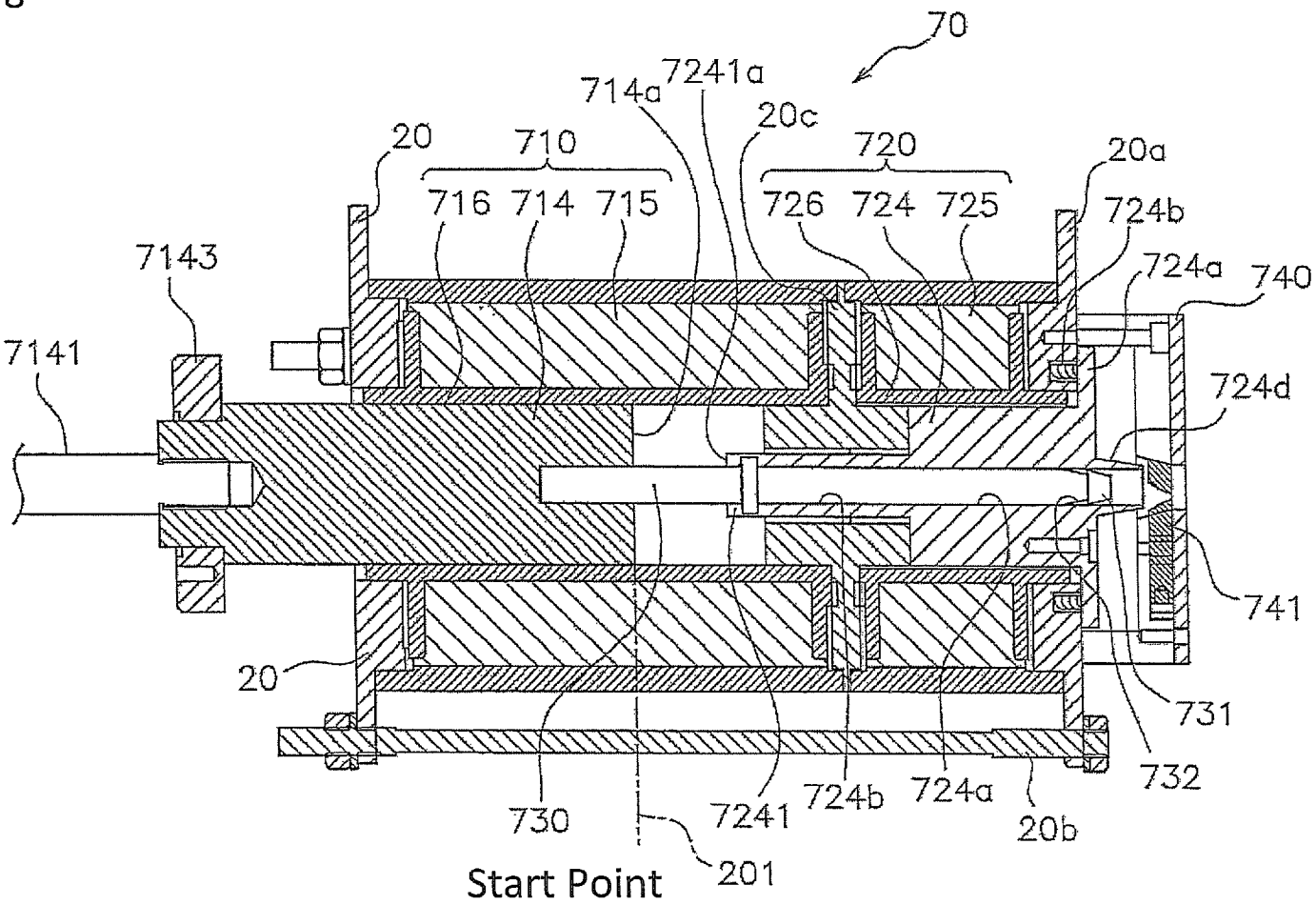
FIG. 7A is a diagram showing one example of a stopping mechanism (at a start point)
Figure 7B:
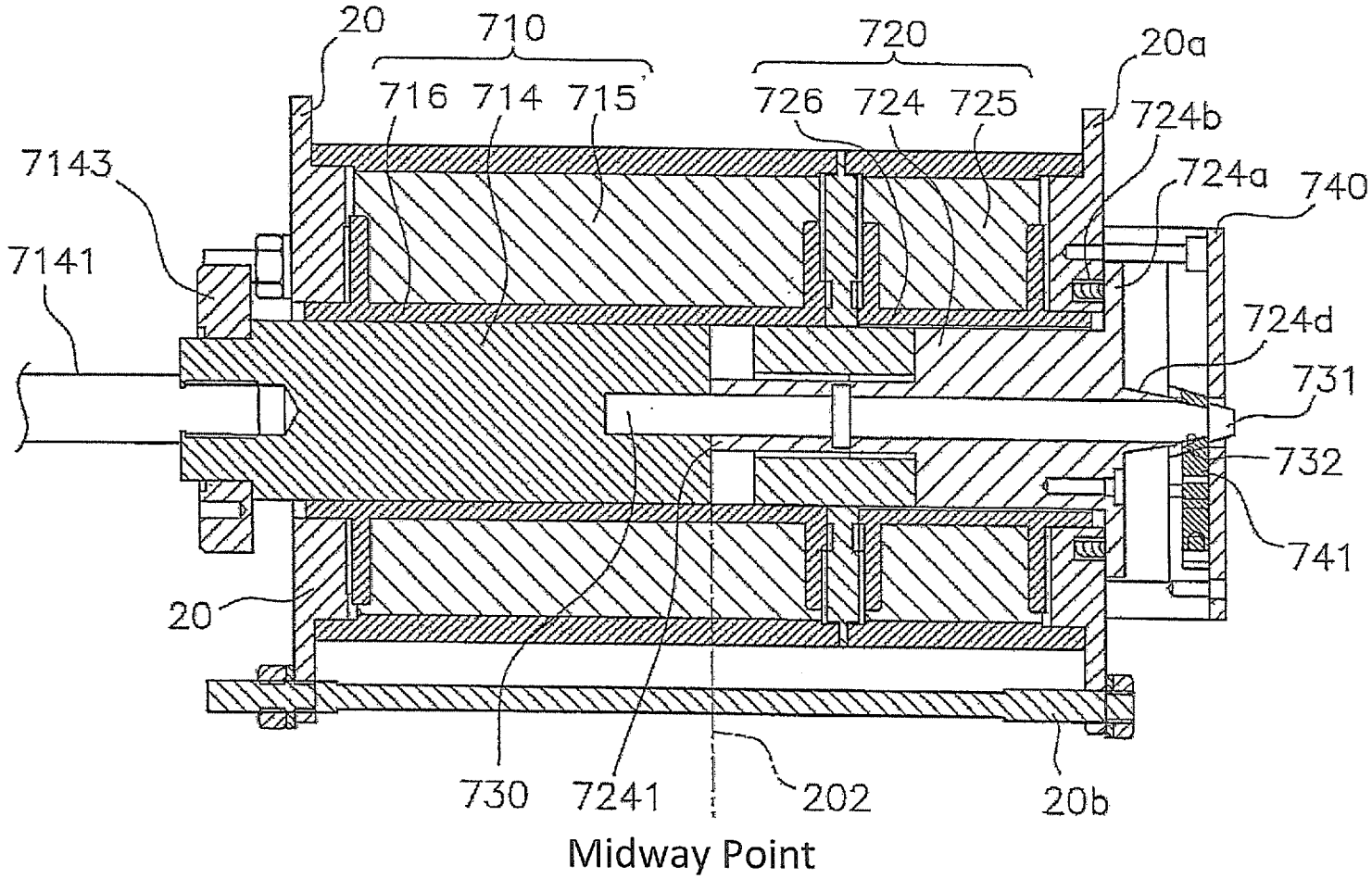
FIG. 7B is a diagram showing one example of the stopping mechanism (pausing at a midway point)
Figure 7C:
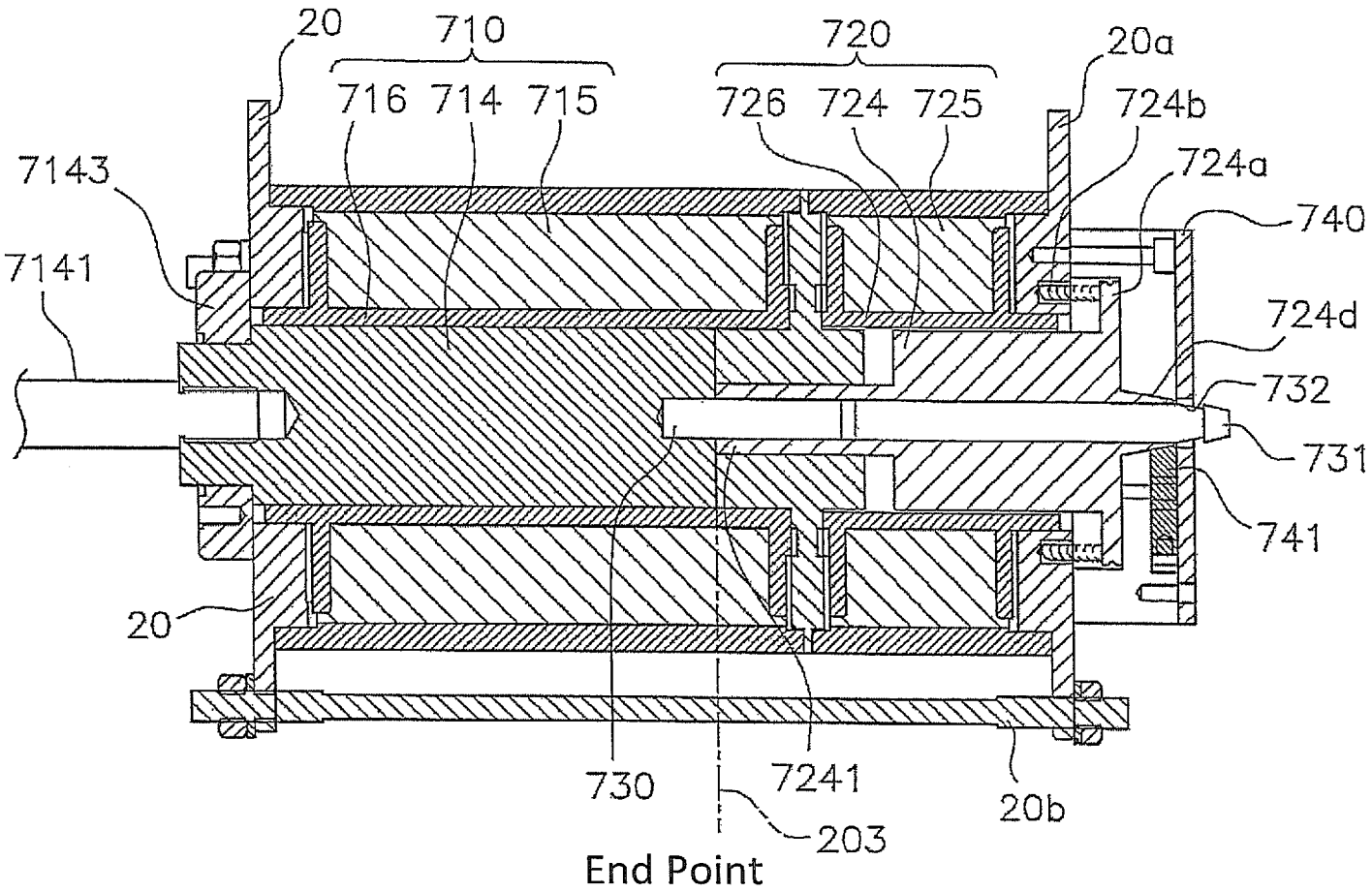
FIG. 7C is a diagram showing one example of the stopping mechanism (at an end point).

The stopping mechanism 70 in FIG. 7A to FIG. 7C includes a second linear solenoid 720 arranged adjacent to the first linear solenoid 710. A first support member 20 supports one side of the first linear solenoid 710, a second support member 20*a* supports one side of the second linear solenoid 720, a third support member 20*b* fixedly supports the first support member 20 and the second support member 20*a*, and a fourth support member 20*c* is interposed between the first and second linear solenoids 710 and 720 so that they support each other (see FIG. 7A).

A pin 730 is secured to the first movable iron core 714 of the first linear solenoid 710 at one end, and moves relative to the second linear solenoid 720 inside a first bore 724*a* extending through the second movable iron core 724.

A midway positioning portion 7241 extends from the second movable iron core 724 of the second linear solenoid 720 toward the first movable iron core 714 and has a second bore 724*b* continuing from the first bore 724*a*. The first movable iron core 714 stops at the midway point 202 (see FIG. 7B) when a distal end portion 714*a* of the first movable iron core 714 abuts on the distal end 7241*a* of the midway positioning portion 7241 at a halt.

When the first movable iron core 714 stops at the midway point 202, a lock part 740 engages with a recess 732 formed at the other end 731 of the pin 730 opposite from its one end that is secured to the first movable iron core 714 to stop the free movement of the pin 730 (see FIG. 7B). In this embodiment, the lock part 740 prevents the pin 730 from moving back. The lock part 740 is configured with a ratchet mechanism 741. While the lock part 740 is attached to the second support member 20*a* in this embodiment, it may be attached to other parts such as the device housing.

A lock release part 724*d* is formed to protrude in a tubular manner at one end of the second movable iron core 724 so that the pin 730 moves inside of it. When the second movable iron core 724 moves with the first movable iron core 714 reaching the end point 203, the lock release part 724*d* enters between the ratchet mechanism 741 of the lock part 740 and the pin 730 to release the recess 732 from engagement (see FIG. 7C).

A first controller 771 (corresponding to "solenoid controller") controls the first linear solenoid 710 (applies power to the electromagnetic coil 715) to move the first movable iron core 714 from the start point 201 to the midway point 202, while controlling the second linear solenoid 720 (applies power to the electromagnetic coil 725) not to slide the second movable iron core 724, so that the first movable iron core 714 stops at the midway point 202. Although the circuitries of the first controller 771 and a second controller 772 to be described later, and wiring with other elements are not shown, these would be obvious to a person skilled in the art.

The first controller 771 then stops the power application to the first linear solenoid 710 during the time when the first movable iron core 714 is pausing at the midway point 202.

To release the first movable iron core 714 from the stop and move the first movable iron core 714 to the end point 203, the first controller 771 then controls the first linear solenoid (applies power to the electromagnetic coil 715) to move the first movable iron core 714 from the midway point 202 to the end point 203, and controls the second linear solenoid (applies no power to the electromagnetic coil 725) to move the second movable iron core 724 in the moving direction of the first movable iron core 714.

The second controller 772 controls the basic operation of the heat seal, and drives the nozzle part 41 and the vacuum pump P.

<Description of Sealing Process Including the Two-Step Holding Action>

First, the seal portion of the object to be sealed is placed in an open state between the pressure element 10 of the pressure lever 7 and the heating element 31*a* of the heating member 31 (step S11). Next, the nozzle part 41 is moved from the waiting position 41*a* to the stop position 41*b* so that the nozzle part 41 is inserted into the object to be sealed (step S12). Alternatively, the object to be sealed may be set after the nozzle part 41 has been moved to the stop position 41*b*.

Next, a first step of holding operation is performed (step S13). After (or before, or at the same time when) the nozzle part 41 has been moved to the stop position 41*b*, the second linear solenoid 720 is turned on (electromagnetic coil 725 is powered), so that the second movable iron core 724 will not slide. Next, the first linear solenoid 710 is turned on (electromagnetic coil is powered), and the first linear solenoid 710 is turned on (electromagnetic coil 715 is powered). This application of power may be performed automatically at a timing in response to a detection signal output from a sensor when it detects that a manual (or foot) switch has been turned on or the sealed portion has been set.

When the first linear solenoid 710 is turned on, the first movable iron core 714 moves to the right in the drawing, and the pressure lever 7 moves downwards with it. The first movable iron core 714 stops at the midway point 202 on its way to the end point 203, where the distal end portion 714*a* of the first movable iron core 714 abuts on the distal end portion 7241*a* of the midway positioning portion 7241, and the pressure lever 7 stops. At this time, a portion near the seal portion of the object to be sealed (position closer to the bag center than the seal portion) is held between the elastic pressing portion 51 and the elastic receiving portion 52 (first held state, see FIG. 7B).

The distal end portion 731 of the pin 730 protrudes from the ratchet mechanism 741, so that the recess 732 is locked by the ratchet mechanism 741. The first controller 721 stops the power application to the first linear solenoid 710 when the first movable iron core 714 is pausing at the midway point 202 (in the locked state). Since the pin 730 is locked, the first movable iron core 714 cannot move and does not return to the start point 201.

Next, the nozzle part 41 sucks out air from inside of the object to be sealed (or supplies gas into the object to be sealed) (step S14). The nozzle part 41 is connected to the vacuum pump P.

After a certain period of sucking (or supplying) action, a second step of holding operation is performed (step S15). The nozzle part 41 is moved from the stop position 41*b* to the waiting position 41*a*. The elastic pressing portion 51 and the elastic receiving portion 52 quickly fill in a gap formed after the nozzle part 41 has been moved.

Next, the second linear solenoid 720 is switched from the ON state to the OFF state, and the first linear solenoid 710 is switched to the ON state (powered state). Thereby, the first movable iron core 714 starts to move again, pressing the distal end portion 7241*a* of the midway positioning portion 7241 rightwards with the distal end portion 714*a* thereof, and stops when the distal end portion 714*a* reaches the end point 203.

At this time, the lock release part 724*d* formed on the second movable iron core 724 enters between the ratchet mechanism 741 and the pin 730 to release the recess 732 from engagement (see FIG. 7C).

As the first movable iron core 714 starts to move again, the pressure lever 7 moves downwards, so that the elastic pressing portion 51 and the elastic receiving portion 52 are compressed to each other, whereby the seal portion of the object to be sealed is held between the pressure element 10 and the heating element 31*a*. When the pressure element 10 reaches the heating element 31*a* following the movement of the pressure lever 7 in this way, the microswitch 6 is turned on by a switch operation mechanism (not shown) to power the Nichrome wire. This fuses the seal portion of the object to be sealed held between the pressure element 10 and the heating element 31*a* and seals the sealed object (step S16). A power switch and a cycle time adjustment knob are provided at positions corresponding to the second controller 722.

Next, to return the first movable iron core 714 from the endpoint 203 to the start point 201, the first linear solenoid 710 is switched to the OFF state (non-powered state), so that the first movable iron core 714 is freed. The first movable iron core 714 moves leftward with the pin 730 released from the lock by the action of a spring (not shown), so that the distal end portion 714*a* returns from the end point 203 to the start point 201. With that, the pressure lever 7 returns upwards to the initial position (step S17). The second movable iron core 724, on the other hand, moves leftward and returns to its initial position by the pulling force of a spring coupled to one end thereof. The sealed object that is appropriately sealed at the now sealed seal portion is then taken out.

In the embodiment described above, the plunger 7143 and the operation rod 7141 of the first movable iron core 714 of the first linear solenoid are arranged on the left in the drawing, moving from left to right and pressing the lower ends 802 of the arms 8 from left to right in the drawing to move the pressure lever 7 from the original position downwards, but the operating mechanism of the solenoid is not limited to this arrangement. For example, the first and second linear solenoids may be reversed left and right, so that the plunger 7143 and the operation rod 7141 of the first movable iron core 714 of the first linear solenoid will be arranged on the right in the drawing, and the plunger 7143 and the operation rod 7141 will move from right to left in the drawing. The arms 8 would rotate around the rotation shaft 9 with this movement of the operation rod 7141 to move the pressure lever 7 downwards.

Other Embodiments

The shape or configuration of the sealed object in the embodiments described above should not be limited to a particular one. The configurations of the pressure element, heating element, nozzle part, nozzle drive unit, and linear solenoids that form the sealing device are not limited to those described above. A plurality of the linear solenoids and stopping mechanisms may be installed in one sealing device.

The linear solenoids and stopping mechanisms in various embodiments described above can be used for driving purposes in other types of sealing devices other than the sealing device described above. In that case, a plurality of the linear solenoids and stopping mechanisms may be installed in one sealing device.

DESCRIPTION OF REFERENCE SIGNS

7 Pressure lever (pressure member)
10 Pressure element
12, 710 First linear solenoid
14 Movable iron core (movable part)
31 Heating member
31*a* Heating element
41 Nozzle part
42 Nozzle drive unit
51 Elastic pressing portion
52 Elastic receiving portion
70 Stopping mechanism
71, 730 Pin
72 Spring
73, 720 Second linear solenoid

The invention claimed is:

1. A sealing device, comprising:

a pressure member having a pressure element for pressing a seal portion of an object to be sealed said seal portion which is a portion to be sealed;

a heating member having a heating element for heating said seal portion;

a nozzle part arranged to be insertable into said object through an opening in said seal portion to suck out gas from inside of the object to be sealed or supply gas into the object to be sealed;

a nozzle drive unit allowing said nozzle part to move between a waiting position and a stop position;

a first linear solenoid comprising a first movable part having first and second end portions, wherein the first end portion is in mechanical communication with the pressure member for driving said pressure member such as to hold said seal portion between said pressure member and said heating member; and a stopping mechanism configured to stop a movement of the first movable part when said first movable part is driven by the first linear solenoid at a predetermined midway point between a start point and an end point after said nozzle part has been moved from said waiting position to said stop position, the stopping mechanism being configured to release said first movable part from a stop to allow the first movable part to move again and reach said end point after said nozzle part has been returned from said stop position to said waiting position;

wherein said stopping mechanism includes:

a pin that makes contact with said second end portion of said first movable part of said first linear solenoid, and a pin moving mechanism that allows said pin to move in accordance with a movement of said first movable part and that stops said pin to stop the movement of said first movable part at said midway point.

2. The sealing device according to claim 1, wherein said pressure member includes an elastic pressing portion pressing a portion near said seal portion, and said heating member includes an elastic receiving portion holding the portion near said seal portion together with said elastic pressing portion.

3. The sealing device according to claim 1, wherein said pin moving mechanism includes a spring arranged at an end different from one end of said pin that makes contact with the distal end portion of said first movable part.

4. The sealing device according to claim 1, wherein said pin moving mechanism includes a second linear solenoid having said pin as a movable part.

5. The sealing device according to claim 1, wherein said pin includes a first diameter part and a second diameter part that has a smaller diameter than the first diameter part, and said pin moving mechanism further includes an engagement portion that engages with said second diameter part of said pin.

6. A sealing device, comprising:

a pressure member having a pressure element for pressing a seal portion of an object to be sealed, wherein said seal portion is a portion to be sealed;

a heating member having a heating element for heating said seal portion;

a nozzle part arranged to be insertable into said object to be sealed through an opening in said seal portion to suck out gas from inside of the object to be sealed or supply gas into the object to be sealed;

a nozzle drive unit allowing said nozzle part to move between a waiting position and a stop position;

a first linear solenoid for driving said pressure member such as to hold said seal portion between said pressure member and said heating member; and a stopping mechanism configured to stop a first movable part of the first linear solenoid when said first movable part is driven by the first linear solenoid at a predetermined midway point between a start point and an end point after said nozzle part has been moved from said waiting position to said stop position, the stopping mechanism being configured to release said first movable part from a stop to allow the first movable part to move again and reach said end point after said nozzle part has been returned from said stop position to said waiting position; wherein said stopping mechanism includes a slide part having an opening portion that makes contact with a plunger of said first movable part to stop the first movable part from moving, and wherein said opening portion has a size that is smaller than an outer diameter of said plunger and larger than an outer diameter of an iron core of said first movable part.

7. A sealing device, comprising:

a pressure member having a pressure element for pressing a seal portion of an object to be sealed, wherein said seal portion is a portion to be sealed;

a heating member having a heating element for heating said seal portion;

a nozzle part arranged to be insertable into said object to be sealed through an opening in said seal portion to suck out gas from inside of the object to be sealed or supply gas into the object to be sealed;

a nozzle drive unit allowing said nozzle part to move between a waiting position and a stop position;

a first linear solenoid for driving said pressure member such as to hold said seal portion between said pressure member and said heating member; and a stopping mechanism configured to stop a movement of a first movable part of the first linear solenoid when said first movable part is driven by the first linear solenoid at a predetermined midway point between a start point and an end point after said nozzle part has been moved from said waiting position to said stop position, the stopping mechanism being configured to release said first movable part from a stop to allow the first movable part to move again and reach said end point after said nozzle part has been returned from said stop position to said waiting position;

a second linear solenoid arranged adjacent to said first linear solenoid;

a pin secured at one end to a first movable part of said first linear solenoid and moving relative to said second linear solenoid inside a first bore that extends through a second movable part of the second linear solenoid;

a midway positioning portion extended from the second movable part of said second linear solenoid toward the first movable part of said first linear solenoid and formed with a second bore continuing from said first bore;

a lock part that engages with a recess of said pin formed at a different end from said one end of said pin to stop the pin from moving when a end portion of the first movable part of said first linear solenoid makes contact with the end portion of said midway positioning portion to stop the first movable part of the first linear solenoid at said midway point, and a lock release part that releases engagement of said recess by entering between said lock part and said pin when a second movable part of said second linear solenoid has moved with the first movable part of said first linear solenoid having moved to said end point.

8. The sealing device according to claim 7, further comprising a solenoid controller that drives said first linear solenoid and said second linear solenoid to move said first movable part from said start point to said midway point and to stop said second movable part, so that said first movable part stops at said midway point, and to move said first movable part from said midway point to said end point and to move said second movable part in a moving direction of said first movable part, so that said first movable part is released from the stop and starts moving again to reach said end point.

9. The sealing device according to claim 8, wherein said solenoid controller stops power application to said first and second linear solenoids when said first movable part is pausing at said midway point.

* * * * *